US006591073B1

(12) United States Patent
Fujii

(10) Patent No.: US 6,591,073 B1
(45) Date of Patent: Jul. 8, 2003

(54) OFFICE PRINTER WITH AUTOMATIC INPUT POWER SENSING AND VARIABLE THROUGHPUT SPEED

(75) Inventor: Wesley Alan Fujii, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/360,347

(22) Filed: Jul. 22, 1999

(51) Int. Cl.[7] ..... G03G 15/00
(52) U.S. Cl. ..... 399/88
(58) Field of Search ..... 399/13, 75, 88, 399/90, 394, 396; 219/216; 323/299, 300; 363/142, 143

(56) References Cited

U.S. PATENT DOCUMENTS 5,349,905 A * 9/1994 Taylor et al. ..... 101/488
5,483,149 A * 1/1996 Barrett ..... 323/300
6,072,585 A * 6/2000 Dutton et al. ..... 399/88 X

* cited by examiner

*Primary Examiner*—Hoan Tran
(74) *Attorney, Agent, or Firm*—Anthony J. Baca

(57) ABSTRACT

When a printer is connected to conventional office power, i.e.. 110 VAC service, it automatically operates in "slowdown-capable" mode. In such a "slowdown-capable" mode, as the printer works harder, it may slow down and reduce performance when there is not enough energy available from the input power source. When the same printer is connected to 220 Volt (or higher) service, it automatically senses this higher input power availability and allows the printer to draw more power from the input, always operating at its highest performance mode to complete the jobs as efficiently as possible. Thus, the printer operates at its highest performance level taking in to consideration the minimum amount of power available and amount of power necessary.

15 Claims, 2 Drawing Sheets

OFFICE PRINTER WITH AUTOMATIC INPUT POWER SENSING AND VARIABLE THROUGHPUT SPEED

TECHNICAL FIELD

The present invention relates to office printers and more particular to an office printer that adjusts its throughput speed based on the amount of power necessary compared to the amount of power available.

BACKGROUND OF THE INVENTION

Present office printer technology has come a long way from the days of impact printing. With the introduction of laser printing, one is able to make high resolution, permanent prints at reasonably fast speeds. The typical office is also increasing its requirements for performance, requiring faster and faster printing, with more and more options and capabilities.

As the progressive office user becomes more and more capable with the available technologies there is a tendency to complete complex printing jobs in the office instead of sending the jobs out to professional printing shops. This is for a variety of reasons, with convenience, timeliness, flexibility and cost being major contributors. With document media selection and finishing capabilities (such as stapling and binding), doing the job in the office can result in a professional-looking end product.

Imagine this possible scenario; the office professional wants to print and distribute packets of materials for an important proposal. The office professional knows that some of the data will not arrive from overseas until the morning of the presentation. For the proposal, the office professional needs letters, section separators, return labels and ballots (questionnaires for feedback on the presentation). The office professional knows that once the information arrives, the job must be completed quickly.

For some currently available high performance laser printers, this type of flexibility is not much of a problem. The printer automatically runs the job and adapts accordingly. For the letter, it pulls office letterhead from the heavy-bond drawer and prints it. Section separators likewise are selected from another input and run through the printer. The self-stick labels and ballot stock are pulled from other input sources. All of these media types have one thing in common, due to their heavy weight, rough surface or dense nature, they require additional heat from the fuser to melt and bond the toner when compared to regular office paper. On a long job, this situation becomes critical because this extra heat may be required faster than it can be supplied. In this particular situation, the printer has been programmed to change its throughput speed in order to retain acceptable fusing performance. Such a change in throughput speed can be accomplished by printing at the same speed, but allowing more time between printed pages or slowing the velocity the paper travels through the printer; either method, or a combination, may be referred to as changing the throughput speed of the printer. For the customer that is in a hurry, this may not be acceptable.

In other printers that may not be as sophisticated, the printer is not programmed to change throughput speeds to preserve overall finished-article quality, instead the printer loses fusing performance and print quality suffers. Examples of this may be smeared print, spots, blobs, streaks, and offsetting (recurring images at regular intervals). In cases where the toner is inadequately fused to the media, the printed image will not remain adhered to the media and may fall off, or may be rubbed or brushed off later. Other non-image related problems may occur if printer performance is exceeded. Media jamming, internal mechanism contamination, filter clogging and office environment contamination (dirty walls near the printer) due to the excessive loose toner in the printer may occur as well These items also have a negative effect on customer satisfaction.

There are limits to the amount of energy that can be safely drawn from a wall outlet. The power supply, circuitry and programming are all designed with safety and margins involved, which results in limiting printer operation to the lowest typically available power. Therefore, the maximum printer performance of the standard printer is limited by the typical power availability; for the United States, this is 110 VAC and 15 ampere service. With these limitations, the customer experiences their high performance printer reduced in performance equivalent to a medium performance printer. While this may be acceptable for some customers for a while, a busy office may demand high performance at all times especially from their network printer. Large offices may be able to afford replacing their printer with a commercial high volume printer as needed, however most customers will want to just have their standard office printer grow as their office requirements grow.

When an office originally purchases the printer, they may be on a limited budget but will want to purchase a printer that will grow as the office grows. Therefore they choose a basic, modular printer that they can immediately use and purchase additional capability as the office can afford them. In most cases, they will think only about their current printing and paper handling needs, especially if it is their first printer. In addition, they usually choose one that they can immediately plug in without doing any facilities changes.

As their office grows they eventually purchase all of the mechanical printer accessories that their jobs require. As their job capabilities, requirements and complexities grow, they find that their once high-performance printer becomes reduced in performance to a level that is significantly and noticeably degraded as described above.

Prior to the present invention, the user can not improve, or even regain, the printer's performance. They are left with the choice of replacing what they have just paid to upgrade, or to just do without. If they replace the printer for a commercial unit, it likely to require heavier, more substantial power service. This, along with the cost of the commercial printer, is a significant expense.

SUMMARY OF THE INVENTION

There is provided an imaging device having multiple throughput speeds of operation. To accomplish the invention there is a universal power supply connected to an external power source. An input power sensor is attached to the universal power supply. The input power sensor generates a power signal indicative of an amount of power available from the external power source. A controller receives the power signal and monitors power requirements of the imaging device. The controller selects the highest throughput speed of safe operation based on the power available and the power needed to operate at that speed.

There is also provided a method for operating an imaging device. An amount of available power is determined, based primarily on the voltage of the power source. The imaging device configuration is determined. A maximum throughput speed at which the imaging device can operate is calculated, where the maximum throughput speed is dependent on the amount of available power and the imaging device configuration. The imaging device is then limited to operating no faster then the maximum throughput speed calculated.

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

The present invention is not limited to a specific embodiment illustrated herein. With the present invention, when the printer is connected to conventional office power, i.e.. 110 VAC service, it automatically operates in "slowdown-capable" mode. In such a "slowdown-capable" mode, as the printer works harder, it may slow down and reduce performance when there is not enough energy available from the input power source. When the same printer is connected to 220 Volt (or higher) service, it automatically senses this higher input power availability and allows the printer to draw more power from the input, always operating at its highest performance mode to maximize customer satisfaction and complete the jobs as efficiently as possible. Using the preferred embodiment, the printer operates at its highest performance level taking in to consideration the amount of power available and amount of power necessary.

Figure 1:
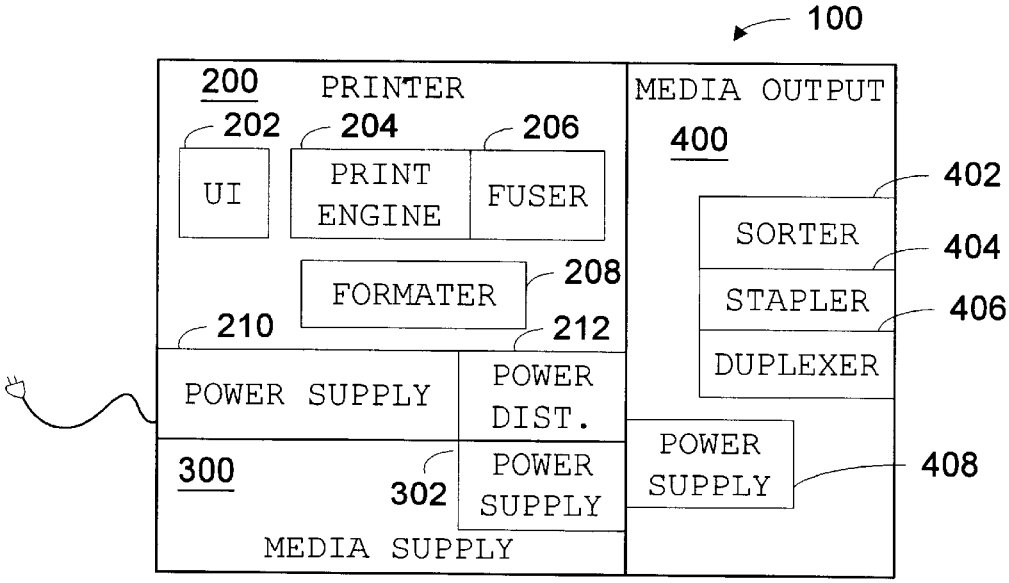
FIG. 1 is a high level block diagram in accordance with the present invention.

Referring particularly to FIG. 1, there is shown a block diagram of an office printer 100 incorporating the present invention. Office printer 100 is shown with printer 200 and optional media supply unit 300 and media output unit 400. These particular options are not meant to limit the present invention but are used here to aid the reader in understanding the preferred embodiment. As described above, a small office may initially purchase printer 200, which has a limited media supply and limited output handling capabilities. Printer 200 contains all the necessary subsystems, as know by one skilled in the art, to print. In particular, printer 200 contains a User Interface (UI) 202, which may consist of an input device such as a keypad and a output device such as a display. Also included is a formatter circuit assembly 208, which converts the data received into a format that the print engine 204 uses to create an image on the media. Fuser 206, uses high temperature and pressure to fuse the image onto the media as is generally the largest power consumer. Printer 200 also includes a power supply 210 and power distribution 212. Power supply 210 converts the input power from the electrical outlet into the required operating voltages as needed by the printer. Power supply 210 should be designed such that it can accept a variety of input voltages. Power distribution 212 is responsible for distributing both power and power information to the optional accessories.

Figure 2:
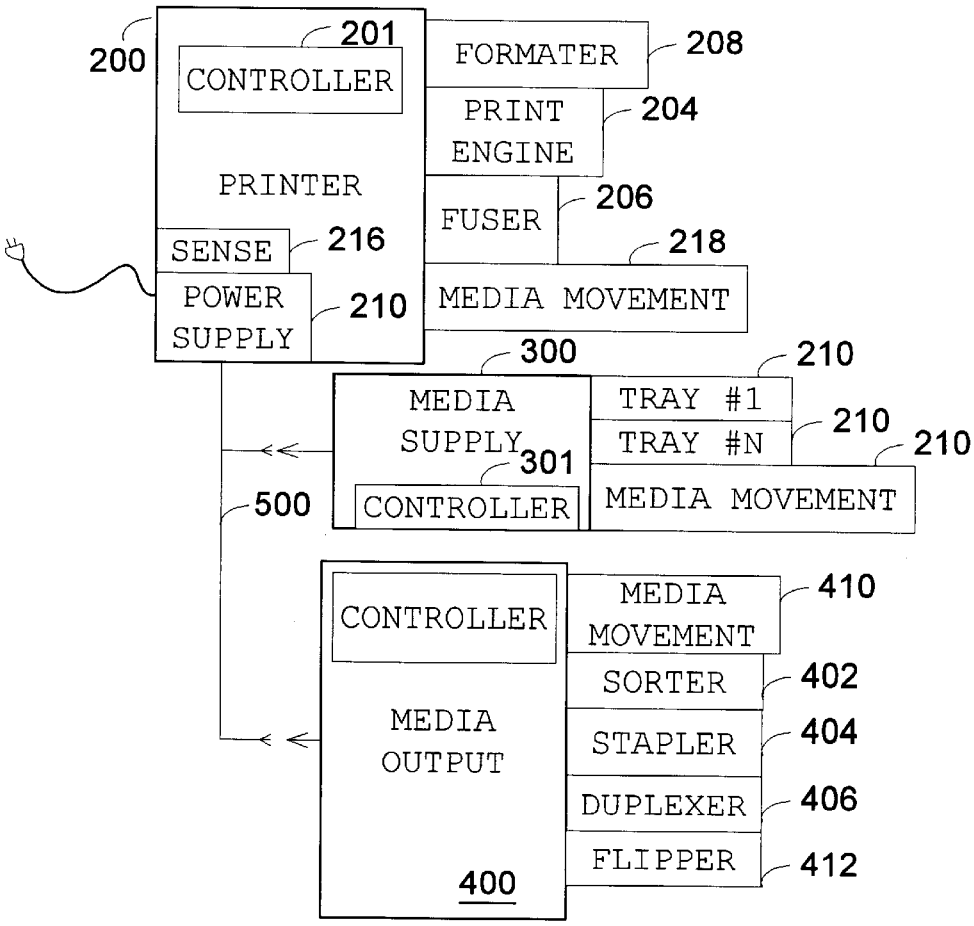
FIG. 2 is an alternate high level block diagram in accordance with the present invention.

Referring next to FIG. 2. The office printer of FIG. 2 is shown in a block schematic format. Printer 200 includes several major subsystems. Power supply 210, formatter 208, print engine 204, and fuser 206 were described in relation to FIG. 1. Media movement 218 represents all the motors, gears, and diverters that cause the media to move through the printer. Sense 216 senses the input voltage and may also sense the number and type of accessories attached to printer 200.

Bus 500 connects the accessories to the printer 200. In the preferred embodiment, Bus 500 includes power and communication channels, however, the present invention is not limited to such an arrangement. Bus 500 may pass power only while data communication is handled through a second I/O channel such as an IR channel. Alternatively, Bus 500 may only include data communications through any number of I/O formats (IR, RF, wires, Magnetic, etc.). Power for each accessory may come directly from the wall outlet. Independent of the structure of bus 500, Sense 216 monitors the input voltage and relays this information to the printer controller 201. Printer controller 201 uses the information from Sense 216 to estimate the amount of power available compared to the amount of power needed to run at full speed given the present configuration.

The media supply accessory 300 includes a controller 301 for communicating with printer 200 and managing proper operation of the media supply 300. Media supply 300 includes multiple paper trays 306-308. Each paper tray may be designed for high capacity, different types of paper, or different sizes. Media movement 310, as in printer 200, represents all the motors, gears, and diverters that cause the media to move through the media supply accessory.

The external media output accessory 400 includes a controller 401 for communicating with printer 200 and managing proper operation of the media output 400. Media output 400 may include several operations such as a sorter 402, stapler 404 and media movement 410. Duplexer 406 may be part of the media output accessory, or it may be a separate accessory that attaches directly to the printer 200. Flipper 412 is used to change the orientation of the paper thereby allowing the media output to output either face-up or face-down.

A single 15 amp, 110 VAC outlet in the United States can deliver about 1650 watts. Assuming Printer 200 uses about 1500 watts during full speed printing. The addition of accessories, such as media supply 300 or media output 400, may cause power consumption to exceed the available power. To remain within the power limit, printer 200, with accessories, must slow down throughput thereby allowing it to consume less power. Some printers may consume more than 1650 watts at full speed without any accessories. Such printers may not reach full speed while plugged into the 15 amp 110 VAC outlet.

Figure 3:
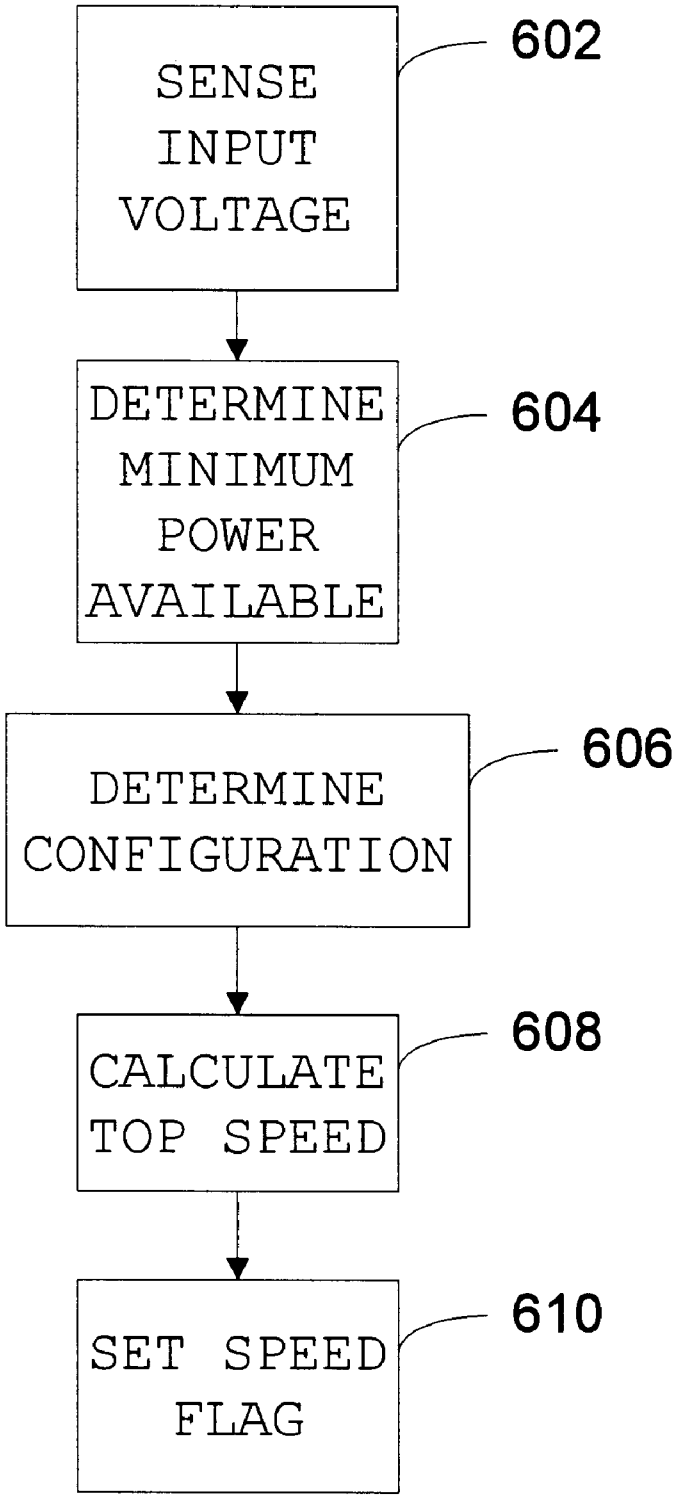
FIG. 3 is a flow diagram.

When printer 200 is turned on and as part of its initialization process it will execute the operations as shown in FIG. 3. In short, the minimum amount of power available and the amount of power necessary to run at full speed must be determined. Given this information, printer can then determine when it must reduce its throughput speed in order to not exceed the amount of power available. Referring in detail to FIG. 3, Printer 200 senses the input voltage 602. From the input voltage, Printer 200 determines the minimum amount of power available 604. This may be accomplished several ways, such as a look up table to cross reference the input voltage to a minimum current rating or, the user of the printer could us the UI 202 to input the size of the circuit breaker for the given line.

Printer 200 determines the present configuration. Given the present configuration the printer then calculates the highest throughput speed that it can safely operation in. If the office printer 100 has several optional accessories, there may be multiple speed limitations depending on which of the optional accessories are being used. Information, such as a flag, is then used to convey to the printer controller, under what conditions, must its throughput speed be reduced.

With that description of the preferred embodiment, some alternative embodiments will be described. Printer 200 may include sensors within Fuser 206 to detect degrading fusing performance. Such sensing may be accomplished by sensing the temperature of the fusing process. Controller 201 monitors these sensors and may reduce printing speed when fuser performance begins to degrade.

As stated above, each accessory may receive power from printer 200 or it may independently plug into its own outlet. However, if each accessory receives power from printer 200, then only printer 200 is required to have a universal power supply (UPS). Such a universal power supply, as known in the industry, is designed such that it will accept a wide range of input voltage and generate the correct output voltages. It may be cost effective to design power supply 210 as a UPS wherein all accessories receive their power for power supply 210 through power distribution 212. Such a UPS could be designed to accept an input voltage range from 100 to 440 VAC (and conceivably beyond) and report to the controller 201 the voltage input voltage level through sense 216.

One skilled in the art will understand that while the above has been described as related to a printer, any other form of imaging device such as copiers, facsimile machines, or other may benefit from the present invention.

Although the preferred embodiment of the invention has been illustrated, and that form described, it is readily apparent to those skilled in the art that various modifications may be made therein without departing from the spirit of the invention or from the scope of the appended claims.

What is claimed is:

1. An imaging device having a first throughput speed of operation and a second throughput speed of operation, said imaging device comprising:

a universal power supply connected to an external power source;

an input power sensor attached to the universal power supply, the input power sensor generates a power signal indicative of a minimum amount of power available from the external power source; and a controller means for receiving the power signal and for monitoring power requirements of the imaging device, the controller means for selecting the first throughput speed when the power requirements are less than the minimum amount of power available and selecting the second throughput speed when the power requirements are more than the minimum amount of power available.

2. The imaging device of claim 1 wherein the input power sensor further comprising:

a voltage sensor connected to the universal power supply, said voltage sensor sensing the voltage of the external power source; and means for determining the minimum amount of power available based on the voltage of the external power source.

3. The imaging device of claim 1 further comprising:

a media supply in logical communication with the controller means, the media supply using power from the external power source.

4. The imaging device of claim 1 further comprising:

a media output in logical communication with the controller means, the media output using power from the external power source.

5. The imaging device of claim 3 wherein the media supply obtains power from the external power source through the universal power supply.

6. The imaging device of claim 4 wherein the media output obtains power from the external power source through the universal power supply.

7. A method for operating an imaging device, the method comprising the steps of:

determining minimum amount of available power;

determining the imaging device configuration;

calculating a maximum throughput speed at which the imaging device can operate, where the maximum throughput speed is dependent on the minimum amount of available power and the imaging device configuration; and limiting the imaging device to the maximum throughput speed.

8. The method of claim 7 wherein the step of determining the minimum amount of available power further comprising the steps of:

sensing the voltage of an external power source; and estimating the minimum amount of available power based on the input voltage.

9. The method as claimed in claim 7 wherein the step of determining the imaging device configuration further comprising the step of sensing the presence or absence of an additional module.

10. A imaging device having an adjustable throughput speed of operation, said imaging device comprising:

a power supply connected to an external power source;

an external power source voltage sensor attached to the power supply; and a controller means monitors the amount of power needed to operate the imaging device and adjusting the throughput speed of operation to prevent the amount of power needed to operate from exceeding a minimum amount of power available from the external power source.

11. The imaging device as claimed in claim 10 the controller means further comprising:

a configuration monitor to determine the configuration of the imaging device.

12. The imaging device as claimed in claim 11 further comprising:

a print engine connected to the controller means; and a fuser connected to the controller means and arranged to receive a media from the print engine.

13. The imaging device as claimed in claim 11 further comprising:

a removable media input supply, the removable media input supply connected to the controller means and configuration monitor, the removable media input supply increasing the amount of power needed operate the imaging device; and a removable media output device, the removable media output device connected to the controller means and configuration monitor, the removable media output device increasing the amount of power needed operate the imaging device.

14. The imaging device as claimed in claim 13 wherein the removable media input supply and the removable media output device arranged to receive power from the power supply.

15. The imaging device as claimed in claim 13 wherein the removable media input supply and the removable media output device arranged to receive power from the external power source.

* * * * *